United States Patent [19]

Lincoln

[11] Patent Number: 4,984,302

[45] Date of Patent: Jan. 15, 1991

[54] NOSE-WORN AIR FILTER

[76] Inventor: Robert A Lincoln, 8325 Murphy Rd., Laurel, Md. 20707

[21] Appl. No.: 174,393

[22] Filed: Mar. 28, 1988

Related U.S. Application Data

[63] Continuation-in-part of Ser. No. 28,702, Mar. 20, 1987, abandoned.

[51] Int. Cl.[5] ..... A42B 1/18; A62B 23/06

[52] U.S. Cl. ..... 2/206; 128/206.11; 128/206.14; 128/206.18; 128/204.12

[58] Field of Search ..... 2/206, 174, 9; 128/206.18, 206.14, 206.12, 206.11, 201.18, 204.12

[56] References Cited

U.S. PATENT DOCUMENTS

| | | | |
|---|---|---|---|
| 701,538 | 6/1902 | Carence | 128/206.11 X |
| 2,672,138 | 3/1954 | Carlock | 128/206.11 X |
| 3,722,509 | 3/1973 | Nebel | 128/206.11 X |
| 3,747,597 | 7/1973 | Olivera | 128/206.11 |
| 4,220,150 | 9/1980 | King | 128/206.11 |
| 4,240,420 | 12/1980 | Riaboy | 128/206.14 |
| 4,573,461 | 3/1986 | Lake | 128/206.11 |

FOREIGN PATENT DOCUMENTS

| | | | |
|---|---|---|---|
| 0684622 | 3/1930 | France | 128/206.18 |
| 0830545 | 5/1938 | France | 128/204.12 |
| 0945897 | 12/1948 | France | 128/206.18 |
| 2417304 | 9/1979 | France | 128/206.11 |

*Primary Examiner*—Peter Nerbun

*Attorney, Agent, or Firm*—Roylance, Abrams, Berdo & Goodman

[57] ABSTRACT

A device is disclosed which attaches to the nose and filters the air a person breathes through the nostrils of the nose. The filter element of the device covers the nostrils and base of the nose. Thus, the remainder of the face is uncovered. The device includes the filter element and an adhesive strip which includes two substantially triangular portions designed to adhere to the sides of the nose and hold the filter in place. The adhesive strip is such that it securely holds the filter over the nostrils when the adhesive strip is properly placed on the sides of the nose. The filter element can be constructed of various materials. For example, cotton, wool, polyester, or carbon. The filter element can include specially designed inserts which are dome shaped or ellipsoidal shaped and which fit in or against the nostrils. The filter element can filter out unwanted gases, solid particles, and/or other matter.

9 Claims, 4 Drawing Sheets

NOSE-WORN AIR FILTER

CROSS REFERENCE TO RELATED APPLICATION

This application is a continuation-in-part of copending U.S. patent application Ser. No. 07/028,702; filed Mar. 20, 1987 now abandoned.

BACKGROUND OF THE INVENTION

There are many masks which may be worn for filtering dusty or otherwise impure air for people who wish to purify the air that is passing into their lungs. These generally fit over the nose and mouth and are held in place by a string, an elastic strip or string, or strings or strips which fit around the back of the head or ears, or by adhesive which holds the filter in place in some way. Some of these masks are relatively expensive, and some are rather inexpensive.

The use of a filter to clean or purify the air people breath is not new, and many filter masks have been designed to fit over the nose and mouth. Many of these masks are uncomfortable for various reasons and have other faults as well. Many allow unfiltered air to get around parts of the masks which don't hold tightly against the curves on the face of the wearer. Some of these masks may cause the face to perspire and to collect dust on the face around the edges of the masks. They also tend to cause fog to form on the eyeglasses of the wearer. My invention reduces the discomfort of wearing a mask, the air bypass or leakage, perspiration, and the fogging of eyeglasses which are caused by the wearing of other masks. My invention is relatively inexpensive to produce, is light in weight, and is held tightly in place without any strings or straps which go around the head or the ears.

My invention has significant benefits over other inventions in the field. Some inventions (U.S. Pat. Nos. 4,240,420 and 4,354,489 to Riaboy) use an adhesive strip which goes around the edge of the mask and holds it in place. To hold the mask in place, this strip adheres to the bridge of the nose, the upper lip, and the part of the face around the nose. Disadvantages of this mask are that heat, perspiration, and moist air from the lungs are trapped within the mask. This, along with the movement of the facial skin, tend to loosen the mask and let air in and out along the edges, and lessen its ability to stay on the face. In addition, the warm air discharged around the upper part of the nose will fog the eyeglasses of the wearer.

Another invention (U.S. Pat. No. 4,004,584 to Geaney) has a filter element held to the base of the nose with an adhesive strip around the perimeter of the element which adheres to the base of the nose. One of the disadvantages of this filter is that it has to be shaped accurately for each nose in order that the adhesive portion engages the outside areas of the base of the nose. Another disadvantage is that the air passing through the filter and the filter's weight pull the adhesive directly away from the skin; thus, the filter would fall off rather easily in active use. My invention eliminates these disadvantages.

Other air filtering masks which press against the face all around the nose (such as U.S. Pat. No. 3,695,265 to Brevik) allow air to escape and enter all around the edges of the masks because it is difficult to get their shape to conform exactly to the different facial contours of different people. The air entering around the edges isn't filtered, and the air escaping around the top of the masks will cause condensation on the eyeglasses of a wearer. In addition to these disadvantages, if the mask is held on with an adhesive strip around the perimeter of the mask (like the Riaboy, supra, inventions), the mask will loosen easily and be likely to fall off in active use. If the mask is held on by a spot of adhesive against the tip of the nose (like the Brevik, supra, invention) the force of the air passing out of the mask and the weight of the mask will pull the adhesive almost directly away from the nose and cause the mask to come off the face rather easily. My invention eliminates all these problems.

Breathing filters held against the base of the nose with strings and mechanical devices (such as disclosed in the French Patent No. 684,622 of Ogrisek and Piccard) have the disadvantages of being difficult to fit and to adjust the strings and other mechanical parts. In addition, the mechanical part would interfere with the eyeglasses of a wearer of eyeglasses, the device could get knocked off the nose easily, and the bearing points of the mechanical device would probably put uncomfortable pressure against the nose. My invention is comfortable, is not easily dislodged, is easy to apply, will fit easily and properly on almost any wearer, and needs no adjustment.

SUMMARY OF THE INVENTION

The invention is a device which enables its user to breath filtered air through the nostrils of the nose while the user's mouth is accessible for talking, eating, and other purposes. The device covers essentially only the nostrils and is attached to the nose with one or more adhesive strips. Thus, the device provides its user greater freedom and less discomfort than other dust masks. It is light in weight and has no string or strap going around the head to hold it in place. It is attached only to the nose, and is attached in such a way that is is held on very tightly while still being comfortable and easy to remove. It is inexpensive to produce; thus, it can be disposed of rather than having to change filter elements once the filter is clogged or dirty. Some of the significant problems associated with the present state of the art breathing masks are the problems they cause for people who wear eyeglasses. The masks interfere with the eyeglass bearing points on the nose and ears. There is no such interference from my invention. The present state of the art masks allow air to escape near the eyeglass lenses, and this causes the lenses to get foggy. My invention discharges the warm moist air from the lungs in a direction away from the eyeglasses of the wearer; thus, there is no condensation on the eyeglasses of the wearer, or at least, less of a problem with fogging.

An important characteristic of my invention is the mode of attachment to the nose of the user. My mode of attachment isolates the nose and utilizes its shape to provide great holding ability to the adhesive strips. The adhesive strips adhere to substantially the entire sides of the nose and may overlap at the top of the nose to hold the filter in place. The method of attachment is very important for a nose filter held in place with an adhesive. This is because the force of moving air and the weight of the filter are constantly working to loosen the adhesive. When one breathes out, the force of the air pushing against the filter tends to push the filter off the nose or face. Thus, the ability of the adhesive strips to hold onto the skin is critical. The holding ability can be increased by increasing the adhesive quality of the adhesive used on the strips. However, the adhesive quality of the adhesive cannot be so great as to cause harm to the skin when the mask is being removed. Another technique of getting more adhesiveness to the strips without increasing the adhesiveness of the adhesive on the strips, is to make the forces of the weight of the filter and the wearer's breathing pull on the adhesive strips at angles such that the force vectors acting on the strips go through the planes of the adhesive strips where they are attached to the skin and force the strips toward the skin. My invention makes use of this feature of forcing the adhesive strips toward the skin. The technique can be used because of the shape of the nose. When viewing noses from the front, the shapes of most of them appear to be triangular. My invention's adhesive strips attach to the sides of the nose, that is, the sides of this triangle. Thus, the force vectors acting on the strips pull the adhesive strips toward the skin rather than away from it or parallel to its surface, a distinct improvement and advantage.

In other inventions such as those discussed above as background to my invention, these force vectors generally pull at angles which force the adhesive parallel to or away from the skin rather than toward the skin. In other words, there is a tendency to lift the adhesive strips off the skin, contrary to the arrangement according to my invention. In my invention, the adhesive strips are constantly pulled toward the adhesive side and toward the skin in distinction from the prior art.

The angles of pull on the adhesive on the Riaboy, supra, inventions are generally different from those on mine. These angles of pull on the adhesive of the Riaboy, supra, inventions are parallel to or away from the skin. The angles of pull on the Geaney, supra, invention are also different. The Geaney, supra, invention attaches to the base of the nose (the area around the nostril openings and the septum) and the vector forces pull on the adhesive strip in such a way as to lift it off the skin. Masks using the Riaboy, supra, or the Geaney, supra, adhesive systems would probably not stay attached nearly as well as my mask would.

Another characteristic of my invention is that it uses adherence to almost the entire surface of nose; whereas, the Riaboy, supra, inventions adhere to the area of the face all around the nose, including only a part of the sides and top of the nose. In the Geaney, supra, invention, the device adheres to only the base of the nose to hold the filter on, whereas any adherence to the base of the nose with my invention is just to form a seal to stop the passage of air around the edges of the filter element. However, such an adhesive seal is not a necessary part of my invention, as the filter element of my invention flexes around the base of the nose to form a natural pressure seal. The inventions of Riaboy, supra, and Geaney, supra, also appear to be more susceptible to being loosened by forces caused by the wrinkling of the face or talking. My invention is not as suscepible to such forces.

In addition, my invention includes a versatile filter element which allows the wearer to select from a variety of filters designed to filter out various sizes of particles, gases, or other matter. These versatile filter elements include elements which are ellipsoidal shaped or dome shaped, and they fit into or against the nostril openings. The areas of the filter which are increased in thickness or bulge at the nostril openings can be called protuberances in the filter. The areas of increased thickness of the filter push up into the nostril openings, are located opposite the openings on the side of the filter element away from the nose, or can be on both sides of the filter; that is, on the side against the nose and the side away from the nose. When the protuberances stick out on both sides of the filter, they are football-like or ellipsoidal shaped. When they are only on one side of the filter, they are dome shaped.

The protuberances have the effect of providing a greater amount of surface area for air to enter and leave the filter than is allowed by a flat filter. This enables the filter to be made thicker without diminishing the flow of air through it as much as would be the case with a thicker flat filter.

The protuberances are also good containers for filtering material. They can be filled with the same filtering material as the filter element is composed of, they can be filled with charcoal, or they can be filled with any other filtering material which will enable the filter element to do a particular job. Materials such as charcoal would enable one to use the filter to filter out undesireable gases in the air. The protuberances can be filled with loose material held together within the cloth-like outer portions of the filter elements, or they can be filled with a molded part which is held in place against the nostril by the cloth-like outer portions of the filter element.

DESCRIPTION OF THE PREFERRED EMBODIMENTS

Figure 1:
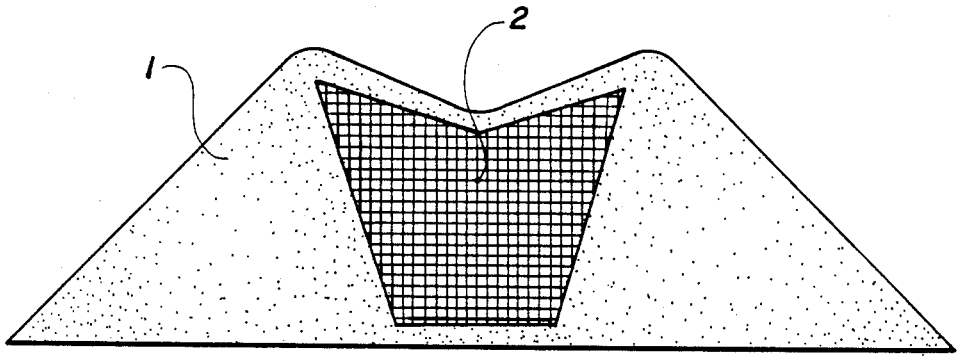
FIG. 1 is a top view of a preferred embodiment of the device in accordance with my invention. This is the adhesive side and would be placed against the nose and the nostrils of the nose. An adhesive strip is used for attachment to the nose. This drawing shows the adhesive strip with no cover over the adhesive.

Referring to FIG. 1, an air filter device, which is to be worn over the nostrils of the nose, includes a specially shaped adhesive strip having an adhesive side 1 having an adhesive substance applied thereto which adheres to the sides of the nose and which is attached to the filter element 2. The filter element 2 is shaped to cover the entire base of the nose, with two substantially triangular portions of the adhesive strip extending along the sides of the user's nose. The adhesive side 1 contacts the sides of the nose and removably fixes the air filter to the nose. (The base of the nose spreads out around the center of the upper lip, and the preferred design of the filter element is shaped to complement the shape of the base of the nose.)

Figure 2:
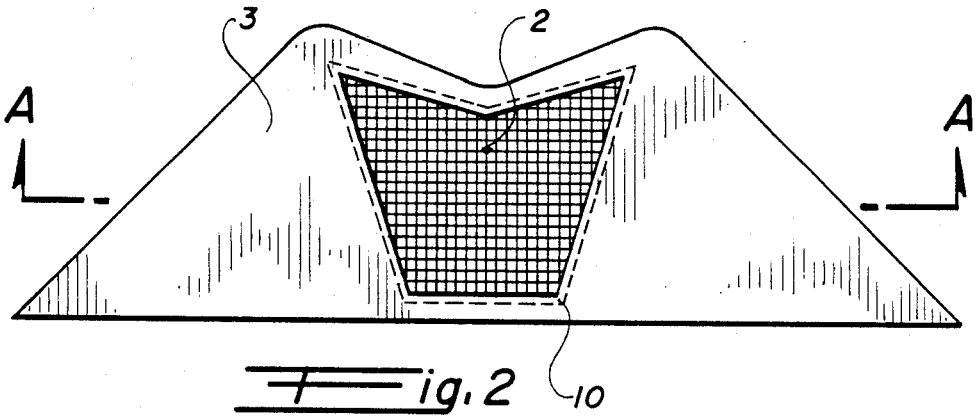
FIG. 2 is a view of the non-adhesive side of the device of FIG. 1. This side of the device would be away from the nose.

Referring now to FIG. 2, the non-adhesive side 3 of the adhesive strip can be seen overlapping the filter element 3 at the area of connection 10 and going all around the filter element. The filter element 2 is attached to the adhesive strip at the area of connection 10 by adhesive and/or stitching.

Figure 3:
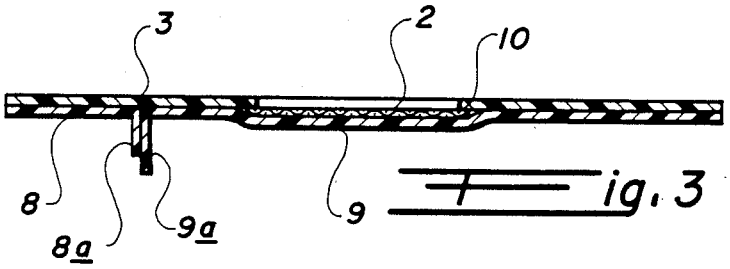
FIG. 3 is a cross sectional view, the section being taken along line A—A in FIG. 2. It shows a two-part plastic cover over the adhesive strip to protect it prior to the adhesive strip being applied to the skin of the wearer.

As best seen in FIG. 3, the adhesive strip is attached to the filter element 2, which is made of woven cloth, by the attachment area 10, as noted above. The adhesive side 1 of the ashesive strip is covered by two thin plastic strips 8 and 9 which are removed prior to placing the adhesive strip against the wearer's skin by a user simply peeling the strips 8 and 9 off, using the free ends 8*a* and 9*a* to access the strips with his or her fingers. The two plastic strips 8 and 9 keep the adhesive strips and the filter element clean prior to use. The filter element 2 is a thin flat piece constructed of woven cloth material which may be cotton, wool, nylon, a synthetic fiber, or any other material which can be formed into a cloth-like structure which can filter particulate matter and/or chemicals out of the air passing over or through it. The filter element 2 allows air to pass through, into, and out of the nostrils in sufficient quantity for normal activity for which it is designed. The filtering effect of the filter can be increased by increasing the thickness of the entire filter element 2 or by adding protuberances which increase the thickness of the filter element in certain areas, by making the open spaces in the cloth smaller, or by adding certain chemicals to the filter.

Figure 4:
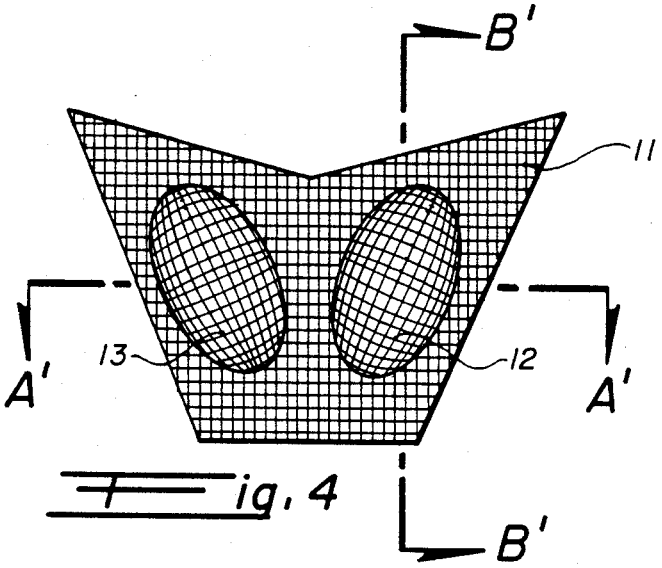
FIG. 4 is a top view of an unique alternate design for a filter element which may be used in a variant of the device illustrated in FIGS. 1-3. This enhances the filter by adding two protuberances to the filter element. The location of the protuberances coincides with the location of the nostril openings of the nose.

Referring now to FIG. 4, an air filter element 11 with a pair of protuberances 12 and 13 which fit into the nostrils of the nose of the wearer and/or are on the side of the filter element away from the nostrils. There is shown the flat part of the filter element. The flat part attaches to the adhesive strip of the nose worn device as shown in FIG. 2. There are two protuberances 12 and 13 in the filter element shown in FIG. 4.

Figure 5:
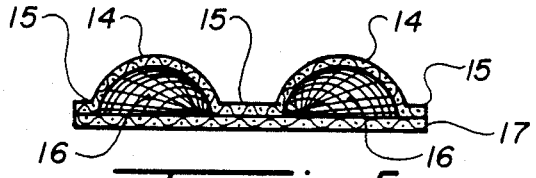
FIG. 5 is a cross sectional view of the filter element shown in FIG. 4, the section being taken along line A'—A'.

Referring to FIG. 5, a sectional view on line A'—A' in FIG. 4, the two protuberances 12 and 13 are shown as being defined by portions 14 and 15 of the filter element's fabric, the portions 14 defining respective domes with respective cavities 16 being defined between the fabric portions 14 and the fabric portion 17, which contacts the fabric portion 15. The fabric is a material which is formed around or encloses the cavities 16 of the protuberances 12 and 13. The cavities 16 may be filled with material such as carbon granules, loose cotton, or any other appropriate filtering material. The element's fabric portions 15 and 17 enclosing the cavities 16 can be sewn or glued together.

Figure 6:
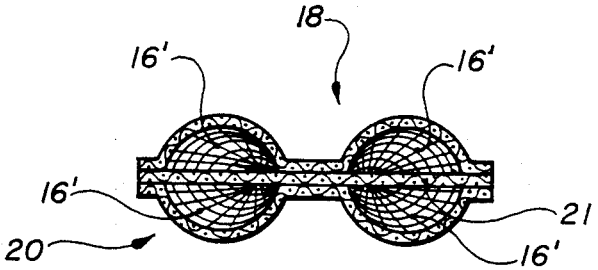
FIG. 6 is a depiction of a cross sectional view similar to that of FIG. 4, the section being taken along line A'—A'. This is what the view would be if the protuberances were on both the upper and lower sides of the filter element, a preferred variant. That is, on both the side toward the nostrils and the side away from the nostrils.

Referring now to FIG. 6, there is shown a variant of the protuberances; in this case, the protuberances are composed of two halves 18 and 20, to define four cavities 16'. The filtering material inside the cavities 16' of the protuberances in the variant of FIG. 6 is held in by a thin piece of air permeable fabric 21 extending over each half. The halves are then glued or sewn together. The two halves form a filter element with ellipsoidal shaped (football shaped) protuberances. One side of the protuberances fits up into the nostrils and the other half juts out on the lower side of the filter element away from the nostrils.

Figure 7:
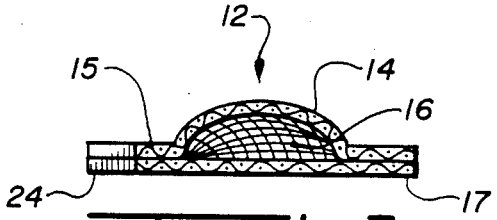
FIG. 7 is a cross sectional view of the filter element shown in FIG. 4, the section being taken along line B'—B'. Depth is shown along one edge.
Figure 8:
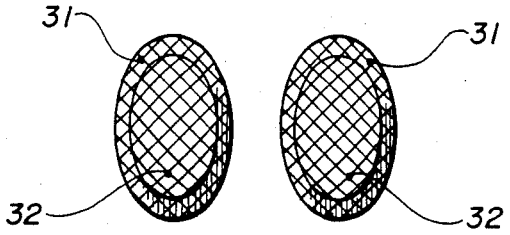
FIG. 8 is a top view of a pair of molded filter inserts for the filter element shown in FIG. 4 and FIG. 6.

Referring to FIG. 7, a sectional view on line B'—B' in FIG. 4, the protuberance 12 is shown with the element's fabric portion 14 and 15 formed around or enclosing the cavity 16. In FIG. 7, 17 designates the fabric portion also illustrated in FIG. 5, while 24 designates a visible inclined surface of the air filter element 11 (FIG. 4). Referring now to FIG. 8, two molded inserts designed to fit into the cavities 16' of FIG. 6 and form the protuberances 12 and 13 of FIG. 4. The inserts are made of filtering material cemented together or filtering material enclosed by a stiff, perforated, form-shaped outer covering. As shown in FIG. 8, a flat portion or collar 31 is around the ellipsoidal portion 32. For the insert which is cemented together, both the collar 31 and the ellipsoidal portion 32 are made of the same material. For the inserts with loose material inside, the collar is made of the same material as the stiff outer covering, and only the ellipsoidal portion contains the filtering material. The collar 31 of both types of molded inserts is covered with an impervious material, such as a thin coating of polyethelene, to prevent the passage of air through the collar area and consequently require all the air to pass through the central portions of the inserts.

Referring to FIG. 8, a bottom view of the inserts, the collars 31 are visible as respective thin flat portions of the inserts and are used to form a seal around the respective inserts when they are in the nostrils of the wearer. The collars 31 prevent air from passing around the inserts without going through the core of the inserts. (The collars could be made of an impervious material such as polyethelene.) The thick, rounded portions 32 provide the filtering effect provided by the inserts.

Figure 9:
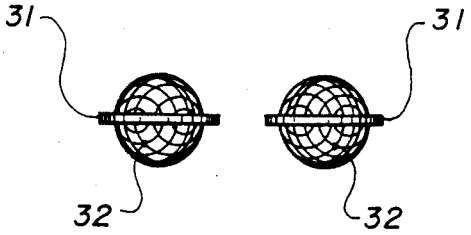
FIG. 9 is a bottom view of the inserts shown in FIG. 8.
Figure 10:
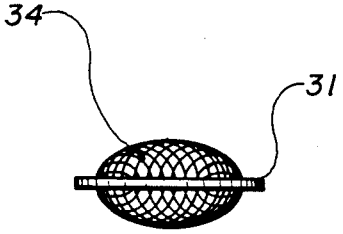
FIG. 10 is a side view of one of the inserts shown in FIG. 8.

Referring now to FIGS. 9 and 10, side views of the inserts of FIG. 8, the flat collar 31 is shown to go around the insert. The elliptical shape of the insert is clearly shown. The thick, rounded portion 34 shows the large surface area and volume provided by the ellipsoidal shape of the insert.

In order to fit the inserts of FIGS. 8–10 into the cavities 16' of the filter shown in FIG. 6, the portions of the thin piece of fabric 21 within the cavities 16' would be cut away.

Figure 11A:
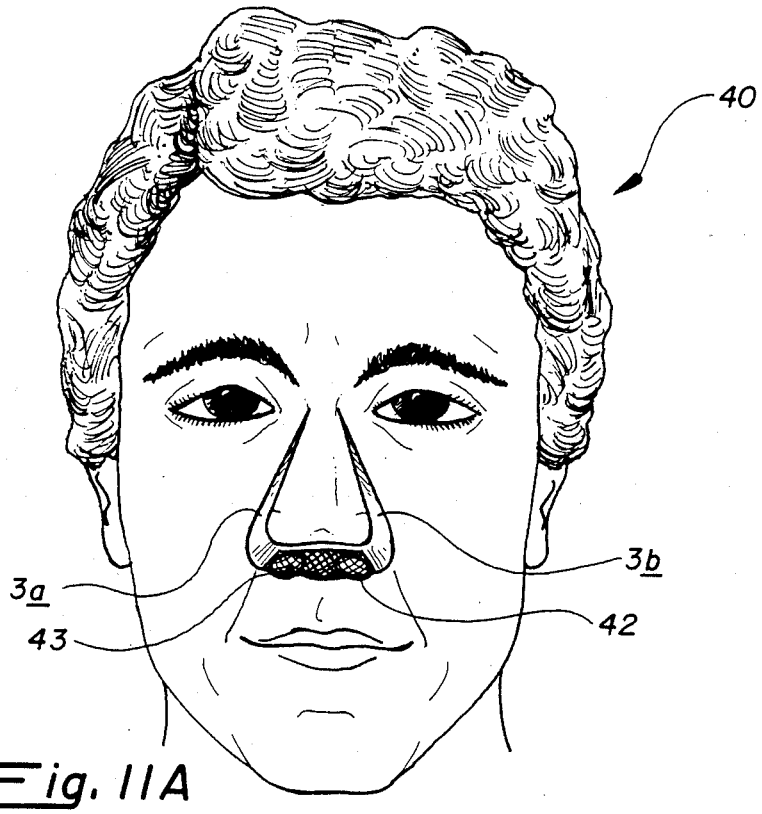
FIG. 11A is a front view of the face of a man having an exemplary nose-worn air filter of the present invention in position for use.
Figure 11B:
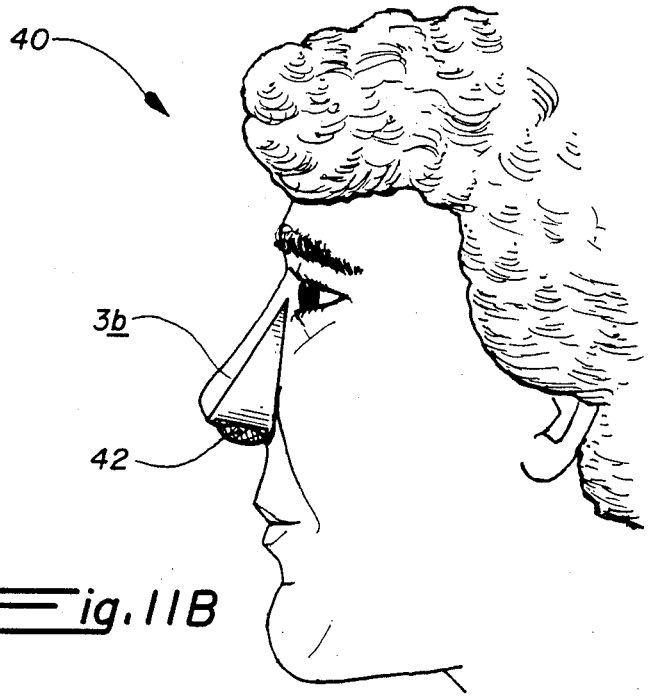
FIG. 11B is a side view of the face of the man in FIG. 11A, the exemplary nose-worn air filter being in place.

Turning briefly to FIGS. 11A and 11B, the exemplary nose-worn air filter is shown in place on the face of a male user 40. As shown, the two substantially triangular portions 3*a* and 3*b* of the nonadhesive side 3, also shown in FIG. 2, of the air filter are shown positioned on opposite sides of the user's nose. The adhesive side 1, also shown in FIG. 1, is in contact with the skin on the sides of the nose, thereby holding the air filter in place. The adhesive side 1 does not contact any portion of the face beneath the nose nor portions of the user's cheeks, a desirable characteristic of my invention. As visible in FIGS. 11A and 11B, the air filter includes protuberances 42 and 43, as do the protuberances which define the lower two cavities 16' (FIG. 6).

It is to be understood that the foregoing description relates to exemplary embodiments and variants of my invention set out by way of example, not by way of limitation. Numerous other embodiments and variants are possible without departing from the spirit and scope of the invention, its scope being defined in the appended claims.

I claim:

1. A nose-worn air filter for covering exterior openings of nostrils and base of a nose of a user and for attaching to sides of the nose, comprising:

a pliant nostril covering portion having a stationary air filtering element positionable over the exterior nostril openings; and a pliant nose attachment portion joined to said nostril covering portion, said nose attachment portion having an adhesive substance on surface portions thereof and including at least two spaced apart pliant portions, said pliant nose attachment portion contacting and adhering to the two respective sides of a user's nose, from side edges of the nose base to upper portions of the nose, free of adhesive contact with other portions of the user's face, said pliant nose attachment portion having respective distal ends the pliant portions being constructed of material which when pressed against the nose adjusts and conforms to detailed curvatures and shapes of noses;

said attachment portion applying said nostril covering portion to the user's nose to form a tight seal against the base and side edges of the base and around the nostril openings and to prevent passage of air around said filtering element and into the nostrils when air is being inhaled by the user.

2. The nose-worn filter of claim 1, including stationary ellipsoidal dome shaped filtering protuberances attached to the stationary air filtering element, said protuberances extending from one side of the filtering element.

3. The nose-worn air filter of claim 2, wherein the two spaced apart pliant portions of the nose attachment portion are substantially triangularly shaped.

4. The nose-worn air filter of claim 1, wherein the two spaced apart pliant portions of the nose attachment portion of said nose-worn air filter are substantially triangularly shaped.

5. The nose-worn air filter of claim 1, including respective form molded stationary filtering inserts of ellipsoidal dome shape, incorporated respectively into said stationary air filtering element, the stationary filtering inserts being constructed of air filtering material and extending from one side of the filtering element.

6. The nose-worn air filter of claim 5, wherein the two spaced apart pliant portions of the nose attachment portion of said nose-worn air filter are substantially triangularly shaped.

7. A nose worn air filter according to claim 1 wherein said nose attachment portion is non-metallic.

8. A nose worn air filter according to claim 1 wherein said nose attachment portion is cloth.

9. A nose worn air filter according to claim 1 wherein said nose attachment portion is plastic.

* * * * *